US006864472B2

(12) United States Patent
Kang

(10) Patent No.: US 6,864,472 B2
(45) Date of Patent: Mar. 8, 2005

(54) EXHAUST AND VENTILATION SYSTEM FOR MOUNTABLE TYPE MICROWAVE OVEN

(75) Inventor: Jeon-Hong Kang, Yongin (KR)

(73) Assignee: Samsung Electronics, Co., Ltd., Suwon-Si (KR)

( * ) Notice: Subject to any disclaimer, the term of this patent is extended or adjusted under 35 U.S.C. 154(b) by 0 days.

(21) Appl. No.: 10/720,149

(22) Filed: Nov. 25, 2003

(65) Prior Publication Data

US 2004/0262303 A1 Dec. 30, 2004

(30) Foreign Application Priority Data

Jun. 24, 2003 (KR) ..... 10-2003-0041240

(51) Int. Cl.[7] ..... H05B 6/80

(52) U.S. Cl. ..... 219/757; 219/681; 126/21 A; 126/299 R

(58) Field of Search ..... 219/757, 681, 219/756; 126/21 A, 299 D, 299 R

(56) References Cited

U.S. PATENT DOCUMENTS 4,327,274 A * 4/1982 White et al. ..... 219/757
4,332,992 A * 6/1982 Larsen et al. ..... 219/681
4,786,774 A * 11/1988 Kaminaka ..... 219/757
5,981,929 A * 11/1999 Maeda et al. ..... 219/757
6,509,556 B2 * 1/2003 Kim ..... 219/757

FOREIGN PATENT DOCUMENTS

KR 1020020057147 7/2002

* cited by examiner

*Primary Examiner*—Philip H. Leung
(74) *Attorney, Agent, or Firm*—Staas & Halsey, LLP

(57) ABSTRACT

A mountable type microwave oven including a blower fan assembly installed at a rear-upper portion of a cabinet to cool a machine room and ventilate a cooking chamber. The microwave oven includes a cabinet mounted on a wall of a cooking space, or under a storage cabinet, and having a cooking chamber to cook food therein and a machine room to house a plurality of electrical components, which are isolated from each other, an exhaust path to exhaust contaminated air generated from a cooking appliance installed below the wall-mounted microwave oven, a cooling-ventilation path to cool the machine room and to ventilate the cooking chamber, and a blower fan assembly including a drive motor having a pair of shafts to generate a rotating force, an exhaust fan joined to one shaft of the drive motor to generate a suction force and a propulsive force to cause the contaminated air to flow along the exhaust path, and a cooling-ventilation fan joined to the other shaft of the drive motor to generate suction and propulsive forces to cause air to flow along the cooling-ventilation path. Since the cooling-ventilation fan performs cooling of the machine room and ventilation of the cooking chamber, there is no need to provide an additional blower fan. Thus, the number of components of the microwave oven is reduced, thereby reducing production costs and improving productivity.

16 Claims, 4 Drawing Sheets

EXHAUST AND VENTILATION SYSTEM FOR MOUNTABLE TYPE MICROWAVE OVEN

CROSS-REFERENCE TO RELATED APPLICATIONS

This application claims the benefit of Korean Application No. 2003-41240, filed Jun. 24, 2003, in the Korean Intellectual Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven, that includes a blower fan assembly installed at a rear-upper portion of an oven cabinet to cool a machine room as well as to ventilate a cooking chamber.

2. Description of the Related Art

Generally, a conventional wall-mounted type microwave oven is installed over an oven range in a cooking space, and serves to carry out a function of exhausting air contaminated by exhaust gas generated from the oven range disposed therebelow, to the outside, as well as a cooking function as in a conventional microwave oven.

The wall-mounted type microwave oven includes an oven cabinet forming an appearance, which is provided with a cooking chamber to cook foods, and a machine room to house various electrical components required to operate the microwave oven. The cooking chamber and the machine room are isolated from each other by a partition plate. The conventional wall-mounted type microwave oven further includes an exhaust path to guide contaminated air generated from an oven range installed below the microwave oven to a discharge point for the contaminated air outside the microwave oven. An exhaust fan to causes the contaminated air to flow along the exhaust path.

Furthermore, the wall-mounted microwave oven includes a cooling-ventilation path to discharge contaminated air generated from the cooking chamber outside the microwave oven as well as to cool the electrical components housed in the machine room. A separate cooling-ventilation fan causes the contaminated air to flow along the cooling-ventilation path.

However, since the conventional wall-mounted type microwave oven includes an exhaust fan assembly having a pair of exhaust fans, which is provided at a rear-upper portion of oven cabinet to discharge contaminated air generated from cooking appliances installed below the microwave oven, and an additional cooling fan to cool the machine room and to ventilate the cooking chamber, there are problems in that manufacture of the wall-mounted type microwave oven is complicated and productivity is lowered owing to an increased number of components.

SUMMARY OF THE INVENTION

Accordingly, it is an aspect of the present invention to provide a wall-mounted type microwave oven, which is constructed with a reduced number of components to improve productivity and ease of manufacture.

Additional aspects and/or advantages of the invention will be set forth in part in the description which follows and, in part, will be obvious from the description, or may be learned by practice of the invention.

The above and/or other aspects are achieved by providing a wall-mounted microwave oven comprising a cabinet mounted at a rear surface thereof on a wall of a cooking space, and having a cooking chamber to cook food therein and a machine room to house a plurality of electrical components, both of which are isolated from each other, an exhaust path to exhaust contaminated air generated from a cooking appliance installed below the wall-mounted microwave oven, a cooling-ventilation path to cool the machine room and to ventilate the cooking chamber, and a blower fan assembly including a drive motor having a pair of shafts at both ends thereof to generate a rotating force, an exhaust fan joined to one shaft of the drive motor to create a suction force and a propulsive force to cause the contaminated air to flow along the exhaust path, and a cooling-ventilation fan joined to the other shaft of the drive motor to create a suction force and a propulsive force to cause air to flow along the cooling-ventilation path.

The cooling-ventilation fan may be positioned on an upper surface of the machine room such that air discharged from the cooling-ventilation fan has a sufficient flow rate to efficiently cool the electrical components in the machine room.

The exhaust path may include a lower path section formed below the cooking chamber and the machine room to draw the contaminated air generated from the cooking appliance disposed below the microwave oven, a rising path section communicated with the lower path section to direct the contaminated air to an upside of the microwave oven, and an upper path section communicated with the rising path section to guide the contaminated air to the blower fan assembly.

The cooling-ventilation path may include a front inlet disposed on a front surface of the cabinet to allow outside air to be introduced into the cabinet, a front outlet disposed on the front surface of the cabinet to allow the air introduced into the cabinet to be discharged to the outside of the microwave oven, a suction path section to guide the air introduced through the front inlet, toward the cooling-ventilation fan, an exhaust path section to guide the air exited from the cooking chamber through the machine room, toward the front outlet, a first communicating hole formed at a side surface of the machine room to allow the air discharged from the cooling-ventilation fan to introduced into the machine room, a second communicating hole formed at a partition plate, which is positioned between the machine room and the cooking chamber to isolate the machine room and the cooking chamber from each other, to allow the machine room to communicate with the cooking chamber, and a third communicating hole to allow the cooking chamber to communicate with the exhaust path section.

The cooling-ventilation fan may be closely positioned over the first communicating hole.

The cooling-ventilation fan may include a centrifugal fan to draw air axially and to discharge the air radially.

The blower fan assembly may be rotatably mounted on the cabinet such that air discharged from the exhaust fan is selectively directed in any direction of forward, upward and rearward directions from the cabinet.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE EMBODIMENTS

Figure 1:
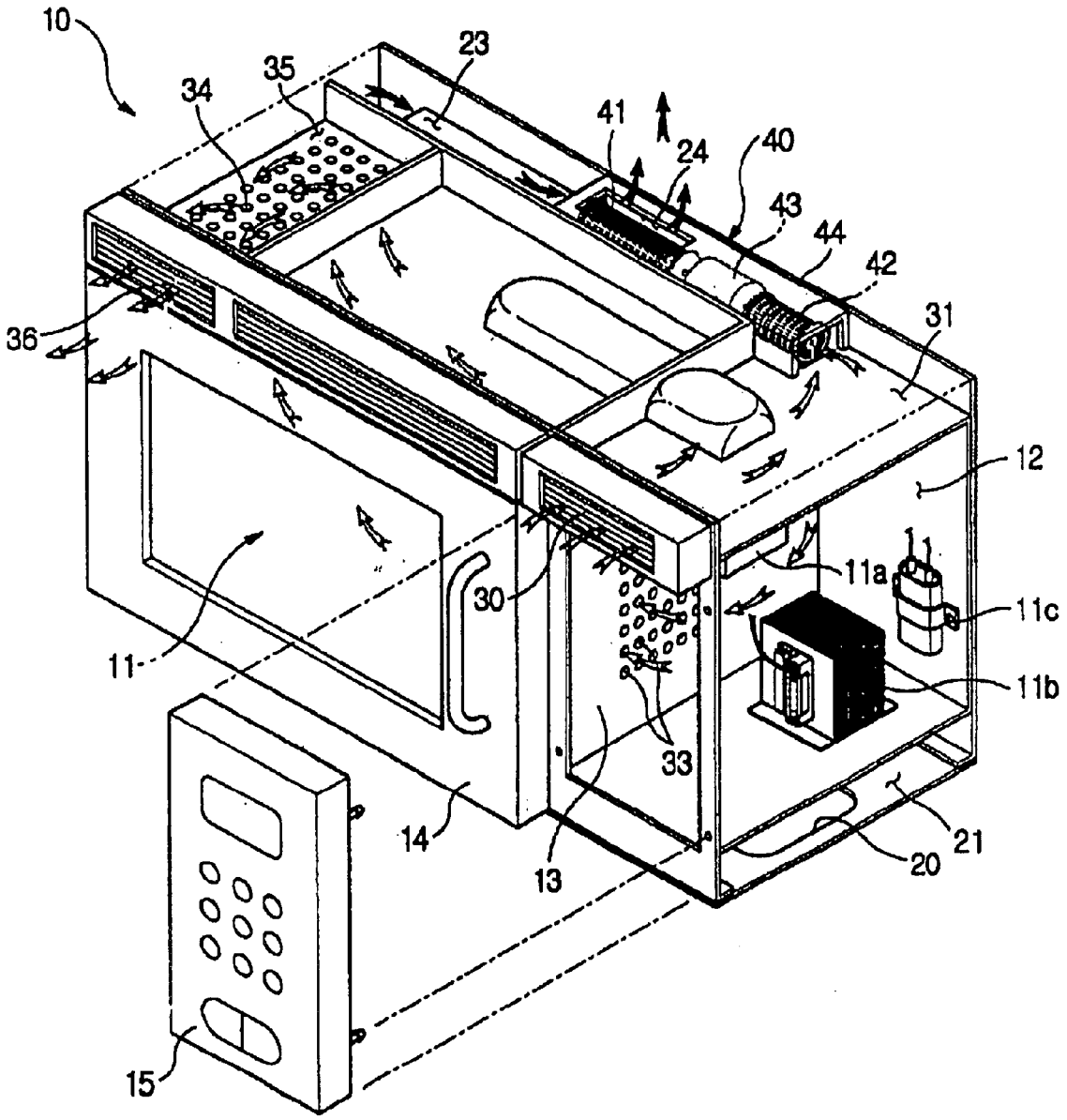
FIG. 1 is a perspective view of a mountable type microwave oven, according to an embodiment of the present invention.

Reference will now be made in detail to the present embodiments of the present invention, examples of which are illustrated in the accompanying drawings, wherein like reference numerals refer to like elements throughout. The embodiments are described below to explain the present invention by referring to the figures.

Figure 2:
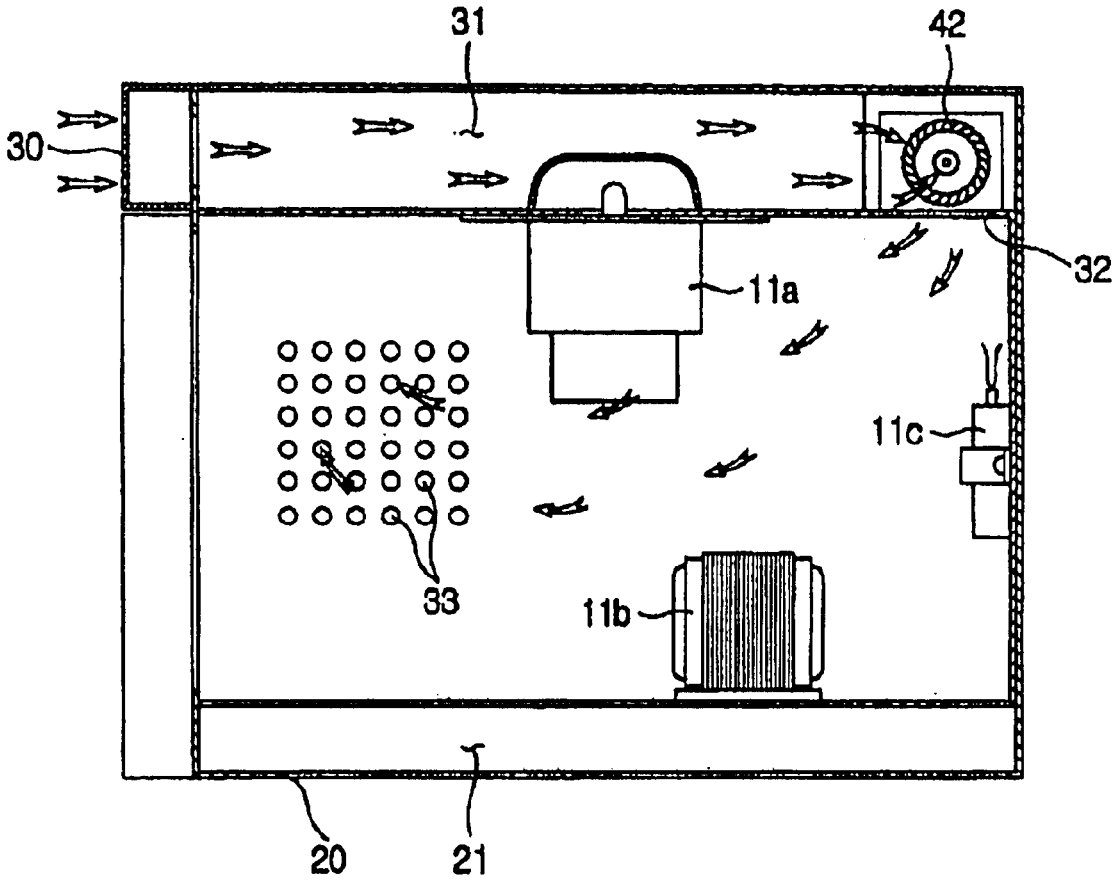
FIG. 2 is a side cross-sectional view of the mountable microwave oven shown in FIG. 1.

As shown in FIGS. 1 and 2, a mountable type microwave oven according to an embodiment of the present invention is securely mounted on a wall of a cooking space over cooking appliances such as an oven range (not shown). A rear panel of a cabinet 10 of the microwave oven is securely attached to the wall in the shown embodiment. The wall-mounted type microwave oven is designed to carry out a function of exhausting air contaminated by exhaust gas generated from the oven range disposed below, to the outside, as well as a cooking function. It is to be appreciated that in another aspect of the present invention the microwave oven may be mounted underneath a storage cabinet of the type typically found in kitchen areas.

The cabinet 10 is provided with a cooking chamber 11 to cook foods therein, and a machine room 12 to house various electrical components required to operate the microwave oven, both of which are isolated from each other by a partition plate 13. The cooking chamber 11 is opened at its front face to permit food to be received in the cooking chamber 11 and to be taken out of the cooking chamber 11. A door 14 is hingedly coupled to the cabinet 10 at the opened front face of the cooking chamber 11 to close and open the cooking chamber 11. The machine room 12 is provided with electrical components, such as a magnetron 11*a* to supply high frequency electromagnetic waves into the cooking chamber 11, a high voltage transformer 11*b* to apply high voltage to the magnetron 11*a*, and a high voltage condenser 11*c*. The control panel 15 controls various functions of the microwave oven.

The wall-mounted type microwave oven according to the shown embodiment of the present invention includes an exhaust path to discharge air contaminated by exhaust gas generated from a cooking appliance installed below the microwave oven, a cooling-ventilation path to circulate outside air through the machine room 12 and the cooking chamber 11 so as to fulfil a ventilation of the machine room 12 and the cooking chamber 11, and a blower fan assembly 40 provided at a rear-upper portion of the cabinet 10 to generate a force to draw air through the cooling-ventilation path and the exhaust path.

Figure 3:
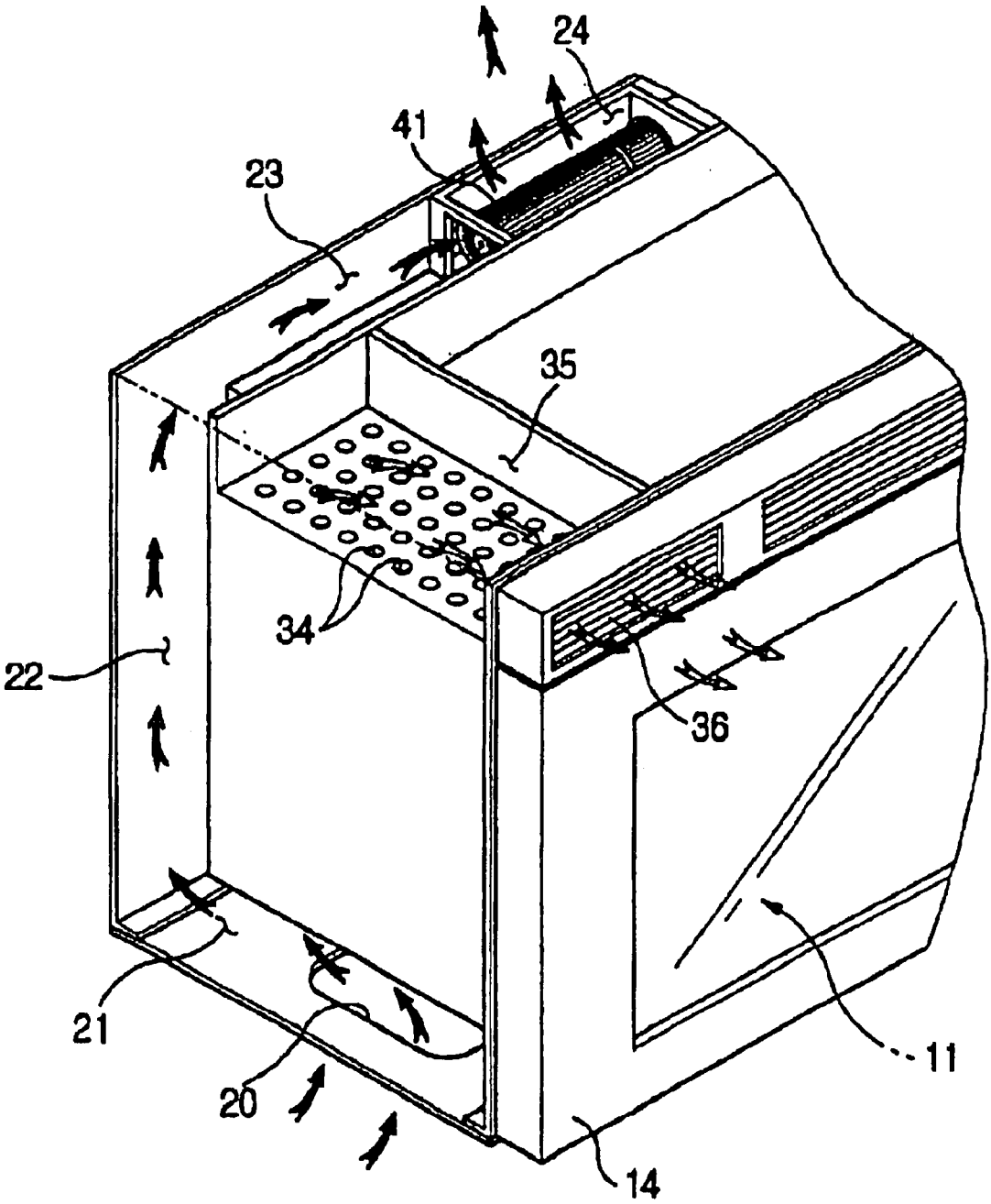
FIG. 3 is a perspective view of the mountable microwave oven shown in FIG. 1, which is viewed from another angle.

As shown in FIG. 3, the exhaust path includes a lower path section 21 formed below the cooking chamber 11 and the machine room 12, a rising path section 22 formed behind the cooking chamber 11 and communicated with the lower path section 21 to guide contaminated air to an upper path section 23 that guides the contaminated air from the rising path 22 to the blower fan assembly 40. The lower path section 21 is defined between lower plates of the cooking chamber 11 and the machine room 12 and a bottom panel of the cabinet 10 and communicated with intake ports 20 formed at the bottom panel of the cabinet 10. The rising path section 22 is defined between the rear plate of the cooking chamber 11 and a back panel of the cabinet 10. The upper path section 23 is defined between an upper plate of the cooking chamber 11 and a top panel of the cabinet 10.

As again shown in FIGS. 1 and 2, the cooling-ventilation path includes a front inlet 30 disposed over the control panel 15 mounted on a front surface of the cabinet 10, to allow outside air to be introduced into the machine room 12 and the cooking chamber 11. A front outlet 36 is disposed at an upper portion of a front face of the cooking chamber 11, to allow the air in the machine room 12 and the cooking chamber 11 to be discharged to the outside. A suction path section 31 guides the air drawn through the front inlet 30 toward the blower fan assembly 40. An exhaust path section 35 guides the air exiting from the cooking chamber 11 toward the front outlet 36.

The upper plate of the machine room 12 is formed with a first communicating hole 32 to allow air, introduced through the front inlet 30, to pass through the suction path section 31, the machine room 12, the cooking chamber 11 and the exhaust path section 35 in this order and to be discharged through the front inlet 30. The partition plate 13, which serves to isolate the machine room 12 from the cooking chamber 11, is formed with second communicating holes 33 to communicate airflow between the machine room 12 and the cooking chamber 11. The upper plate of the cooking chamber 11 is formed with third communicating holes 34 to communicate the cooking chamber 11 with the exhaust path section 35.

Accordingly, air, introduced into the suction path section 31 through the front inlet 30, is guided to the machine room 12 through the first communicating hole 32, thereby cooling the electrical components such as the magnetron 11*a*, the high voltage transformer 11*b* and the high voltage condenser 11*c*. Thereafter, the air in the machine room 12 is introduced into the cooking chamber 11 through the second communicating holes 33, and then guided to the exhaust path section 35 through the third communicating holes 34, while performing a ventilation of the cooking chamber 11. Subsequently, the air in the exhaust path section 35 is discharged to a cooking space through the front outlet 36.

The blower fan assembly 40 includes a drive motor 43 to generate a rotating force in response to application of a power source, a pair of blower fans 41 and 42 joined to both shafts of the drive motor 43 and rotated by the rotating force generated from the motor 43 to generate wind power, and a fan casing 44 to house the drive motor 43 and the pair of blower fans 41 and 42 therein.

Among the pair of blower fans 41 and 42, the blower fan 41, which is disposed on the cooking chamber 11, is communicated at an one end thereof with a downstream end of the upper path section 23 communicating with the rising path section 22 and serves as an exhaust fan to cause the contaminated air to flow through the exhaust path. The other blower fan 42, which is disposed on the machine room 12, is provided in the cooling-ventilation path and serves as a cooling-ventilation fan to cause air to pass the machine room 12 and the cooking chamber 11 while cooling the machine room 12 and ventilating the cooking chamber 11. The pair of blower fans 41 and 42 are centrifugal fans adapted to draw air longitudinally and to discharge the air radially. However, it is understood that other types of fans or pressure differential devices could be used.

In this embodiment, the blower fan assembly 40 is asymmetrically positioned at a rear-upper portion of the cabinet 10 such that the cooling-ventilation blower fan 42 is located over the first communicating hole 32 of the machine room 12. Accordingly, outside air, which is introduced into the suction path section 31 through the front inlet 30, is guided to the machine room 12 to cool the electrical components and then guided to the cooking chamber 11 to ventilate the cooking chamber 11.

The cooling-ventilation fan 42 is closely positioned over the first communicating hole 32 formed at the upper plate of the machine room 12. More specifically, the farther the cooling-ventilation fan 42 is displaced from the electrical components, the less a flow rate of air discharged from the cooling-ventilation fan 42 is, thereby reducing a cooling effect for the components. Therefore, it is preferable, but not required, that the cooling-ventilation fan 42 is disposed at the machine room 12 as close as possible, in order to enable the air discharged from the cooling-ventilation fan 42 and contacting the electrical components, to have a sufficient flow rate to efficiently cool the electrical components.

The cabinet 10 includes an exhaust port 24 formed at a rear-upper portion of the cabinet 10 to allow the contaminated air, which is drawn into the exhaust path by the exhaust fan 41, to be discharged to the outside of the microwave oven. Although not shown in the drawings, the exhaust port 24 may be connected to an exhaust duct equipped in a building, so as to allow the contaminated air to be discharged to the outside of the microwave oven through the duct.

In this embodiment, the contaminated air is shown and described to be upwardly discharged from the blower fan assembly 40, the discharging direction of the air is not limited to this direction, and the contaminated air may be discharged in the front or in the rear of the blower fan assembly 40 by rotating the blower fan assembly 40, depending on the presence or absence of the duct and the position of the duct.

Figure 4:
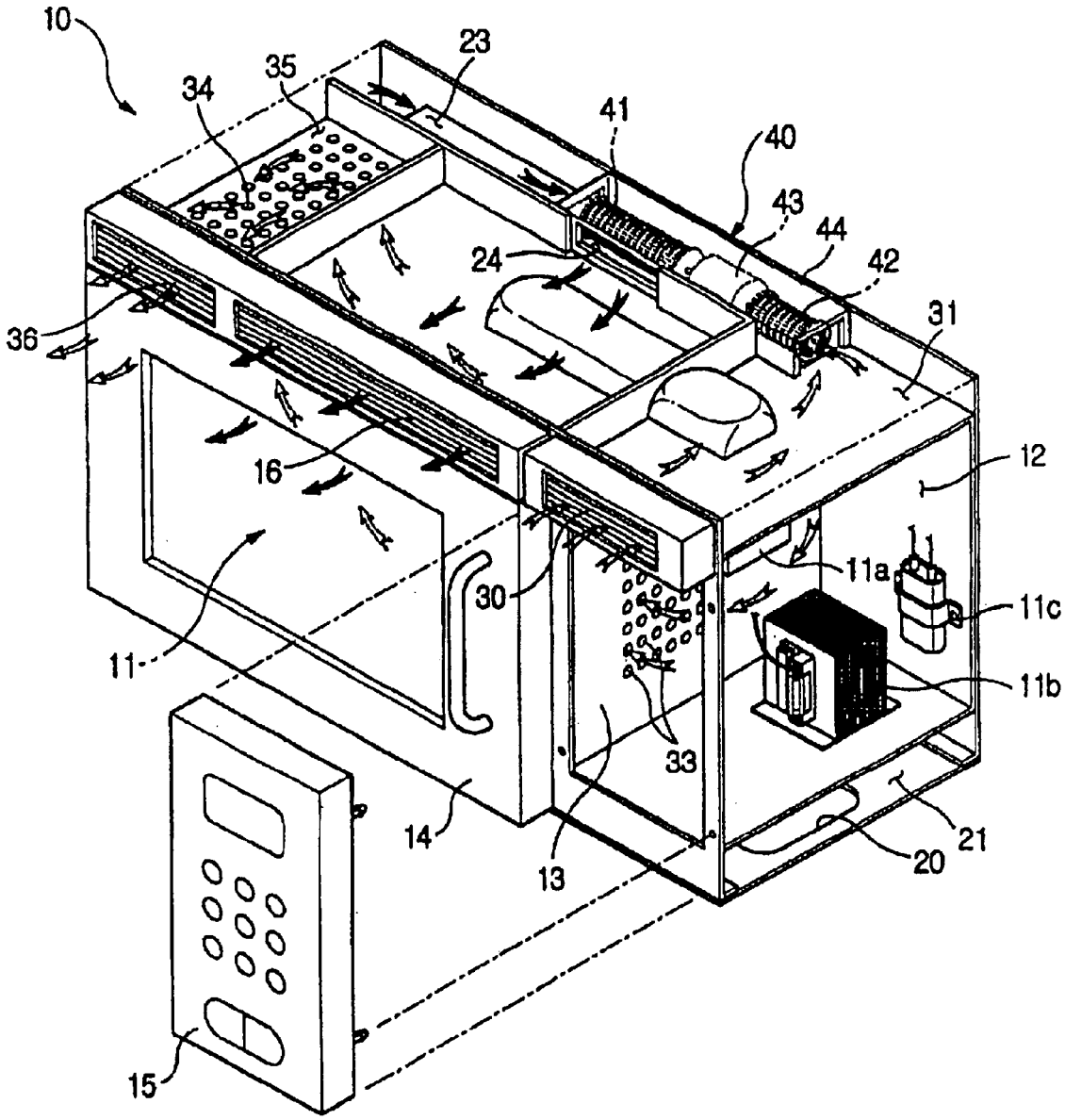
FIG. 4 is a perspective view of a mountable type microwave oven, according to another embodiment of the present invention.

FIG. 4 shows a mountable type microwave oven according to another embodiment of the present invention. As shown in FIG. 4, the blower fan assembly 40 is rotated such that the exhaust port 24 is positioned at the front of the fan casing 44, and a front exhaust port is provided at the front face of the cabinet 10. Consequently, contaminated air, which is discharged from the exhaust fan 41 is discharged out of the front exhaust port 16 from the cabinet 10.

Operations and functions of the mountable type microwave oven according to the embodiments of the present invention will now be described.

When the control panel 15 is manipulated by a user to carry out an exhaust or cooking operation, an electric power is applied to the drive motor 43, and thus the exhaust fan 41 and the cooling-ventilation fan 42 are rotated by the drive motor 43 to generate a suction force and a propulsive force.

Contaminated air, which is generated from cooking appliances disposed below the wall-mounted type microwave oven, is drawn into the lower path section 21 through the intake ports 20, and discharged through exhaust port 24 into the duct equipped in a building (not shown), through the rising path section 22 and the upper path section 23, by the suction force and a propulsive force generated from the exhaust fan 41.

In the meantime, air is drawn into the suction path section 31, and introduced into the machine room 12 through the first communicating hole 32, by the suction and blowing forces generated from the cooling-ventilation fan 42. At this point, since the cooling-ventilation fan 42 is closely positioned over the first communicating hole 32 formed at the upper plate of the machine room 12, the air discharged from the cooling-ventilation fan 42 has a flow rate sufficient enough to efficiently cool the electrical components in the machine room 12. Accordingly, since the air with a high flow rate comes into contact with the electrical components such as the magnetron 11*a*, the high voltage transformer 11*b* and the high voltage condenser 11*c*, the electrical components are efficiently cooled. Subsequently, the air in the machine room 12 is introduced into the cooking chamber 11 through the second communicating holes 33, and discharged from the front outlet 36 through the third communicating holes 34 and the exhaust path section 35, thereby ventilating the cooking chamber 11.

As apparent from the above description, the present invention provides a wall-mounted type microwave oven including a blower fan assembly having an exhaust fan and a cooling-ventilation fan at both ends of the blower fan assembly, in which the exhaust fan functions to exhaust contaminated air generated from cooking appliances installed below the wall-mounted microwave oven, and the cooling-ventilation fan functions to cool a machine room as well as to ventilate a cooking chamber. Accordingly, since there is no need to provide an additional blower fan, the number of components constituting the microwave oven is reduced, thereby reducing production costs and improving productivity.

It is understood that the blower fan assembly 40 could use a gearing assembly to provide different air flow rates in the exhaust and cooling-ventilation paths. Additionally, it is understood that the blower fan assembly 40 can selectively engage fans 41 and 42 according to whether exhaust or ventilation is independently required. For example, the exhaust fan 41 may be used to ventilate the stove top cooking space below the microwave oven when the oven is not in use for cooking.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A wall-mounted microwave oven for use in cooking food comprising:

a cabinet mounted at a rear surface thereof on a wall of a cooking space, and having a cooking chamber to cook the food therein, and a machine room to house a plurality of electrical components for use in cooking the food, and which is isolated from the cooking chamber;

an exhaust path to exhaust contaminated air generated from a cooking appliance installed below the wall-mounted microwave oven;

a cooling-ventilation path to cool the machine room and to ventilate the cooking chamber; and a blower fan assembly including a drive motor having a pair of shafts at both ends thereof to generate a rotating force, an exhaust fan joined to one shaft of the drive motor to create a suction force and a propulsive force to cause the contaminated air to flow along the exhaust path, and a cooling-ventilation fan joined to the other shaft of the drive motor to create a suction force and a propulsive force to cause air to flow along the cooling-ventilation path.

2. The wall-mounted type microwave oven as set forth in claim 1, wherein the cooling-ventilation fan is positioned on an upper surface of the machine room such that air discharged from the cooling-ventilation fan has a sufficient flow rate to efficiently cool the electrical components in the machine room.

3. The wall-mounted type microwave oven as set forth in claim 1, wherein the exhaust path includes a lower path section formed below the cooking chamber and the machine room to draw the contaminated air generated from the cooking appliance disposed below the microwave oven, a rising path section communicated with the lower path section to direct the contaminated air to an upside of the microwave oven, and an upper path section communicated with the rising path section to guide the contaminated air to the blower fan assembly.

4. The wall-mounted type microwave oven as set forth in claim 1, wherein the cooling-ventilation path includes a front inlet disposed on a front surface of the cabinet to allow outside air to be introduced into the cabinet, a front outlet disposed on the front surface of the cabinet to allow the air introduced into the cabinet to be discharged to the outside of the microwave oven, a suction path section to guide the air introduced through the front inlet, toward the cooling-ventilation fan, an exhaust path section to guide the air exiting from the machine room through the cooking chamber and toward the front outlet, a first communicating hole formed at a side surface of the machine room to allow the air discharged from the cooling-ventilation fan to be introduced into the machine room, a second communicating hole formed at a partition plate, which is positioned between the machine room and the cooking chamber to isolate the machine room and the cooking chamber from each other, to allow the machine room to communicate with the cooking chamber, and a third communicating hole to allow the cooking chamber to communicate with the exhaust path section.

5. The wall-mounted type microwave oven as set forth in claim 4, wherein the cooling-ventilation fan is closely positioned over the first communicating hole.

6. The wall-mounted type microwave oven as set forth in claim 1, wherein the cooling-ventilation fan includes a centrifugal fan to draw air axially and to discharge the air radially.

7. The wall-mounted type microwave oven as set forth in claim 1, wherein the blower fan assembly is rotatably mounted on the cabinet such that air discharged from the exhaust fan is selectively directed in any direction from the cabinet.

8. A mountable microwave oven comprising:

a cabinet adapted to be mounted on a support surface having a cooking chamber and a machine room to house a plurality of electrical components for use in cooking food in the cooking chamber;

an exhaust path to exhaust air from a space below the mountable microwave oven;

a cooling-ventilation path to cool the machine room and ventilate the cooking chamber;

a blower fan assembly including a drive motor having a shaft rotated by the drive motor;

an exhaust fan connected to the shaft of the drive motor to create air flow along the exhaust path; and a cooling-ventilation fan connected to the shaft of the drive motor to create air flow along the cooling-ventilation path.

9. The mountable microwave oven as in claim 8, wherein the blower fan assembly is attached to an upper surface of the cooking chamber and the cooling-ventilation fan is positioned over an opening in the machine room.

10. The mountable microwave oven as in claim 8, wherein the cooling ventilation path includes an air inlet positioned on the front of the cabinet.

11. The mountable microwave oven as in claim 8, wherein the machine room and the cooking chamber have openings in adjacent surfaces to permit airflow from the machine room to the cooking chamber.

12. A wall-mounted microwave oven comprising:

a cabinet adapted to be mounted on a support surface, and having a cooking chamber and a machine room that contains a plurality of electrical components for use in cooking food in a cooking chamber;

an exhaust path to exhaust air from a space below the wall-mounted microwave oven;

a cooling-ventilation path to cool the machine room and then ventilate the cooking chamber, and a blower fan assembly including a drive motor having a shaft at each end, an exhaust fan joined to one shaft of the drive motor to create air flow along the exhaust path, and a cooling-ventilation fan joined to the other shaft of the drive motor to create air flow along the cooling-ventilation path.

13. The wall-mounted microwave oven as in claim 12, wherein the blower fan assembly is attached to an upper surface of the cooking chamber and the cooling-ventilation fan is positioned over an opening in the machine room.

14. The wall-mounted microwave oven as in claim 12, wherein the cooling ventilation path includes an air inlet positioned on the front of the cabinet, and an air outlet to allow the ventilation air from the cooking chamber to be discharged out of the cabinet.

15. The wall-mounted microwave oven as in claim 12, wherein the machine room and the cooking chamber have openings in adjacent surfaces to permit airflow from the machine room to the cooking chamber.

16. The wall-mounted microwave oven as in claim 12, wherein the exhaust path is independent of the cooling-ventilation path.

* * * * *